United States Patent [19]

Narita

[11] Patent Number: 4,891,290

[45] Date of Patent: Jan. 2, 1990

[54] PHOTOSENSITIVE MATERIAL FOR ELECTROPHOTOGRAPHY

[75] Inventor: Mitsuru Narita, Matsumoto, Japan

[73] Assignee: Fuji Electric Co., Ltd., Kawasaki, Japan

[21] Appl. No.: 192,470

[22] Filed: May 10, 1988

[30] Foreign Application Priority Data

Jun. 10, 1987 [JP] Japan ..... 62-144546

[51] Int. Cl.[4] ..... G03G 5/14

[52] U.S. Cl. ..... 430/58; 430/65; 430/67

[58] Field of Search ..... 430/66, 67, 58, 85

[56] References Cited

U.S. PATENT DOCUMENTS

| | | | |
|---|---|---|---|
| 4,296,191 | 10/1981 | Jacobson et al. | 430/57 |
| 4,537,849 | 8/1985 | Arai | 430/85 |
| 4,554,230 | 11/1985 | Foley et al. | 430/85 X |
| 4,675,265 | 6/1987 | Kazama et al. | 430/67 |
| 4,710,442 | 12/1987 | Koelling et al. | 430/85 |

*Primary Examiner*—J. David Welsh

*Attorney, Agent, or Firm*—Brumbaugh, graves, Donohue & Raymond

[57] ABSTRACT

A photosensitive material for electrophotography is provided, which comprises in sequence an aluminum substrate, a charge transport layer, a hole injection layer, a charge generation layer, and a surface protection layer, wherein the surface protection layer comprises an arsenic-selenium alloy containing from 35 atomic % to 45 atomic % arsenic.

The photosensitive material may also include a buffer layer comprising an arsenic-selenium alloy disposed between the surface protection layer and the charge generation layer, said buffer layer having a graduated arsenic concentration in which the concentration of arsenic increases in the direction of the surface protection layer. These layers provide enhanced lifetime for the materials while maintaning good print quality. Further, the insertion of the buffer layer allows for high temperature operation.

6 Claims, 1 Drawing Sheet

PHOTOSENSITIVE MATERIAL FOR ELECTROPHOTOGRAPHY

BACKGROUND OF THE INVENTION

The present invention relates to photosensitive material for electrophotography having a surface protection layer on a photosensitive layer for use in electrophotographic devices such as digital copiers and printers.

Since the light source used for these devices is normally a semiconductor layer (LD), a light emitting element (LED) or a combination of an ordinary light source such as a halogen lamp and a liquid crystal shutter (LCS), and the wave length is long, e.g., from 660 to 800 nm, photosensitive material of this kind has generally consisted of a carrier generation layer having sensitivity to such a light source, a carrier transport layer for transporting generated carriers and a surface protection layer for protecting against external objects such as paper or toner. Furthermore, the printing resistance of the photosensitive material is determined by the quality of the surface protection layer.

However, in conventional photosensitive materials, the surface protection layer as well as the carrier generation layer deteriorate after printing about 80,000 to 100,000 sheets and the photosensitive material becomes unusable. Accordingly, surface protection layers made of selenium have been modified by increasing their thickness or changing their composition from pure selenium to a selenium alloy containing 5 to 8 wt % tellurium or selenium alloy containing less than 5 wt % arsenic. The working life of such a surface protection layer is still only about 100,000 to 200,000 sheets. Accordingly, although such modified materials can be used in medium to low speed printers or digital copiers, they are not suitable for high speed digital copiers or printers. Therefore, photosensitive material which increases the printing resistance by using amorphous silicon instead of selenium-type material for the photosensitive layer has been used in the high speed type printers. However, since the amorphous silicon photosensitive material cannot be used without a heater inside the printer, this material is extremely difficult and expensive to use.

Accordingly, the object of the present invention is to overcome the foregoing problems and provide photosensitive material for use in electrophotography that can be used for high speed printers or digital copiers, by increasing the printing resistance as a result of improvement in a selenium-based surface protection layer.

SUMMARY OF THE INVENTION

In accordance with the present invention, a photosensitive material for electrophotography is provided, which comprises in sequence an aluminum substrate, a charge transport layer, a hole injection layer, a charge generation layer, and a surface protection layer, wherein the surface protection layer comprises an arsenic-selenium alloy containing from 35 atomic % to 45 atomic % arsenic.

This invention further relates to a photosensitive material in which a buffer layer comprising an arsenic-selenium alloy is disposed between the surface protection layer and the charge generation layer, said buffer layer having a graduated arsenic concentration in which the concentration of arsenic increases in the direction of the surface protection layer. These layers provide enhanced lifetime for the materials while maintaining good print quality. Further, the insertion of the buffer layer allows for high temperature operation.

DETAILED DESCRIPTION OF THE INVENTION

The present invention relates to a photosensitive material for electrophotography which comprises in sequence an aluminum substrate, a charge transport layer, a hole injection layer, a charge generation layer, and a surface protection layer, wherein the surface protection layer comprises an arsenic-selenium alloy containing from 35 atomic % to 45 atomic % arsenic.

This invention further relates to a photosensitive material in which a buffer layer comprising an arsenic-selenium alloy is disposed between the surface protection layer and the charge generation layer, said buffer layer having a graduated arsenic concentration in which the concentration of arsenic increases in the direction of the surface protection layer.

Figure 1:
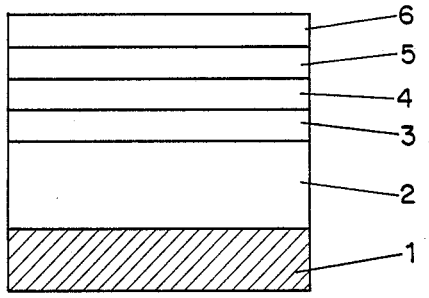
FIG. 1 is a cross sectional view illustrating the layer structure of one embodiment of the present invention.

FIG. 1 shows the cross sectional structure of one embodiment according to the present invention, in which there are laminated on an aluminum substrate 1 a charge transport layer 2 composed of pure selenium, a hole injection layer 3 composed of selenium having a concentration gradient from 0 wt % to 46% tellurium from the side of the charge transport layer, a charge generation layer 4 composed of selenium containing 46 wt % tellurium so as to have a spectral sensitivity at long wavelengths, a buffer layer 5 composed of selenium having a concentration gradient of 0 atomic % to 40 atomic % of arsenic from the side of the charge generation layer 4 and a surface protection layer 6 composed of selenium alloy containing 40 atomic % arsenic, that is, $As_2Se_3$. Examples of such layers are described in commonly owned U.S. patent applications Ser. Nos. 192,469 and 192,471, now U.S. Pat. No. 4,868,077 filed concurrently herewith and incorporated herein by reference. The hole injection layer 3 serves to transport the carriers generated in the charge generation layer 4 smoothly into the charge transport layer 2.

The following non-limiting example is intended to further illustrate the present invention.

EXAMPLE

The photosensitive material described above was prepared as follows. A cleaned aluminum cylindrical substrate 1 was first attached to a vacuum evaporation vessel, and after maintaining the substrate temperature to about 60° C., the inside of the vessel was evacuated to $1\times10^{-5}$ torr. Then a charge transport layer 2 of about 40 μm thickness was vapor deposited by heating an evaporation source containing pure selenium to about 320° C. Then, after recovering the pressure in the vessel to the atmospheric pressure, the substrate was taken out and attached to the support shaft of a flash evaporation furnace. A hole injection layer 3 was flash vapor-deposited to about 0.4 μm thickness by successively depositing selenium alloy in which the tellurium concentration was gradually increased to that of the evaporation source while the temperature of the support shaft was 55° C., the pressure was $10^{-5}$ torr and the temperature of the evaporation source was 350° C. A 46 wt % tellurium-selenium alloy was deposited over the hole injection layer to a thickness of 0.1 μm as the charge generation layer 5, and an arsenic-selenium alloy was then deposited to the thickness of 0.1–0.12 μm as the buffer layer 5. Finally, a surface protection layer was deposited to about 2 μm thickness. The charge generation layer 4 and the surface protection layer 6 were each deposited by means of flash vapor-deposition in the same manner as the hole injection layer 4.

In addition to the photosensitive material having the structure described above and shown in FIG. 1, photosensitive material having no buffer layer was prepared under the same vapor deposition conditions. In addition a comparative photosensitive material with no buffer layer and using 4 wt % arsenic-selenium alloy as the material for the surface protection layer was also prepared for comparison.

Figure 2:
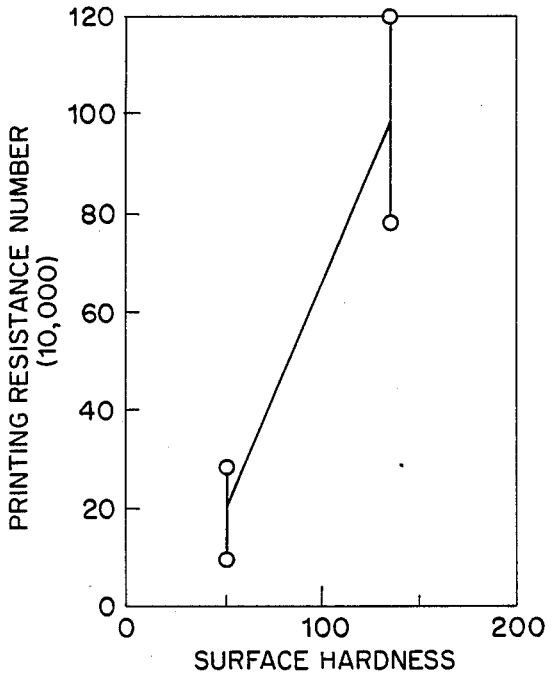
FIG. 2 is a diagram showing the relationship between the surface hardness of surface protection layer and number of the printing sheet showing satisfactory printing resistance.

Measurements of the surface Vicker's hardness, high temperature tests at 40° C., and initial printing test were carried out for the three photosensitive materials described above. The results are shown in Table 1, with o representing acceptable test performance, and x representing unacceptable performance. The number of sheets printed with satisfactory results is related to the surface hardness as shown in FIG. 2.

TABLE 1

| Photosensitive Material | Surface Hardness (Hv) | High Temperature test | Initial Printing |
|---|---|---|---|
| photosensitive materials according to the present invention | 130 | o | o |
| photosensitive material according to the present invention without a buffer layer | 128 | x | o |
| comparative photosensitive material without a buffer layer and 4 wt % arsenic-selenium alloy surface protection layer | 50 | o | o |

The photosensitive materials according to the present invention have surface hardnesses more than 2.5 times greater than the comparative photosensitive material. According to FIG. 2, this means that from about 80,000 to 2,000,000 printing resistant sheets were obtained which can be applied to high speed printers or digital copiers. However, in the photosensitive material according to the present invention with no buffer layer, although there was no cracking at the surface in the high temperature test at 35° C., cracking resulted in high temperature test at 40° C. therefore restricting its use.

Figure 3:
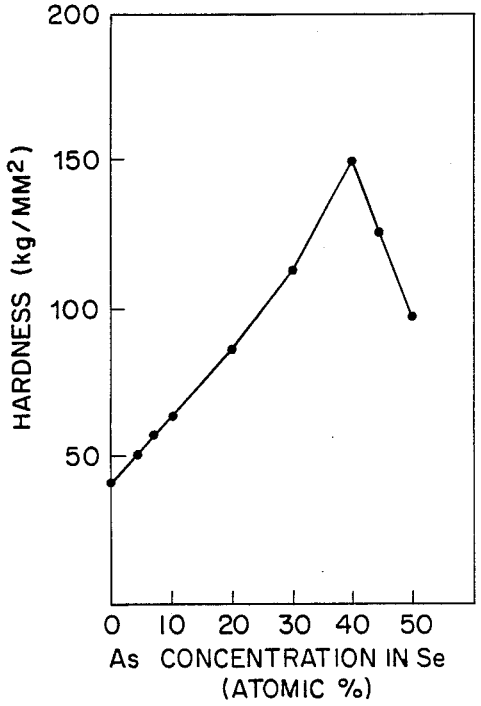
FIG. 3 is a diagram showing the relationship between the hardness and the composition of arsenic-selenium alloy.

As shown in FIG. 3, the composition having 40 wt % As concentration, that is $As_2Se_3$, has the highest hardness among As - Se alloy materials and high printing resistance can be obtained by incorporating As at concentrations approximate thereto. Further, by disposing an As - Se alloy intermediate layer having an As concentration gradient between the surface protection layer and the photosensitive layer, the difference in heat expansion coefficient between the selenium alloy at high arsenic concentration and the selenium alloy of the photosensitive layer is absorbed to prevent the cracking in $As_2Se_3$ layer.

With the present invention, high surface hardness can be obtained by forming the surface protection layer with an arsenic-selenium alloy having a composition of approximately $As_2Se_3$. Photosensitive material incorporating such a layer for use in electrophotography has a high printing resistance. Moreover, by disposing an intermediate layer between the surface protection layer and the photosensitive layer, cracking due to the difference in the heat expansion coefficients between the underlying photosensitive layer and the surface protection layer can also be prevented, allowing use of the material at elevated temperatures.

I claim:

1. A photosensitive material for electrophotography, which comprises in sequence (a) an aluminum substrate;
(b) a charge transport layer;
(c) a hole injection layer;
(d) a charge generation layer;
(e) a buffer layer comprising an arsenic-selenium alloy, said buffer layer having a gradient in arsenic concentration, the concentration of arsenic increasing in the direction of the surface protection layer; and
(f) a surface protection layer, wherein the surface protection layer comprises an arsenic-selenium alloy containing from 35 atomic percent to 45 atomic percent arsenic.

2. A photosensitive material according to claim 1, wherein the concentration of arsenic in the buffer layer ranges from about 0 atomic percent at the interface with the charge generation layer to a concentration substantially equal to that of the surface protection layer.

3. A photosensitive material according to claim 1 wherein the surface protection layer contains 40 atomic percent arsenic.

4. A photosensitive material according to claim 2, wherein the surface protection layer contains 40 atomic percent arsenic.

5. A photosensitive material according to claim 1, 4 wherein the surface protection layer has a thickness of about 2 μm.

6. The photosensitive material according to claim 1, wherein the hole injection layer comprises selenium and tellurium, and the tellurium concentration is in a gradient increasing in the direction from the charge transport layer to the charge generation layer.

* * * * *